United States Patent [19]

Buckley et al.

[11] 4,449,458

[45] May 22, 1984

[54] CARTRIDGE CASE CLOSURE PLUG

[75] Inventors: Michael E. Buckley; Thomas N. Tschirn, both of Dahlgren; Donald R. McClure, King George, all of Va.; Michael S. Wieland, Clairton, Pa.

[73] Assignee: The United States of America as represented by the Secretary of the Navy, Washington, D.C.

[21] Appl. No.: 360,273

[22] Filed: Mar. 22, 1982

[51] Int. Cl.[3] ..... F42B 5/02

[52] U.S. Cl. ..... 102/430; 102/530; 102/532

[58] Field of Search ..... 102/430, 444, 501, 506, 102/532, 448, 530, 531, 452, 462, 463

[56] References Cited

U.S. PATENT DOCUMENTS

| | | | |
|---|---|---|---|
| 1,480,595 | 1/1924 | Bird | 102/532 |
| 1,834,364 | 12/1931 | Woodford | 102/532 |
| 2,476,291 | 7/1949 | Garber | 102/532 |
| 2,484,608 | 10/1949 | Cheyney et al. | 220/444 |
| 3,247,795 | 4/1966 | Abela | 102/439 |
| 3,604,355 | 9/1971 | Greenlees | 102/532 |
| 3,935,816 | 2/1976 | Boquette, Jr. | 102/466 |

FOREIGN PATENT DOCUMENTS

| | | | |
|---|---|---|---|
| 1122418 | 8/1968 | United Kingdom | 102/462 |
| 2081427 | 2/1982 | United Kingdom | 102/529 |

*Primary Examiner*—Harold J. Tudor

*Attorney, Agent, or Firm*—Robert F. Beers; Kenneth E. Walden

[57] ABSTRACT

A cartridge case closure plug for closing a cartridge case, enhancing plug breakup in the shortest time span after ignition of the cartridge, and substantially reducing plug mass to reduce the impact loads exerted on the projectile by the plug. The plug is cylindrically shaped and constructed of a polymeric foam which may be covered with an elastomeric coating to lower the permeability of the plug. The plug is provided with a forward face, a rearward face and an outer cylindrical surface. The forward face of the plug is furnished with a centered depression which allows for center blowout and breakup of the plug upon ignition of the propellant contained in the cartridge case. The rearward face of the plug is provided with a tapered cylindrically-shaped cavity which reduces plug mass and enhances plug breakup while reducing the impact loads on the projectile. The plug is also furnished with a passageway communicating the tapered cylindrical cavity with the outer cylindrical surface of the plug so as to release air entrapped between the plug and the propellant bed when the plug is inserted in the cartridge case.

7 Claims, 3 Drawing Figures

CARTRIDGE CASE CLOSURE PLUG

BACKGROUND OF THE INVENTION

Prior art cartridge case closure plugs are typified by the plug disclosed in U.S. Pat. No. 2,045,004, to Vickers, which discloses a cylindrically shaped plug having a soft core material, such as coarsely ground cork having a low tensile strength, encompassed by an outer shell of granular material. The disadvantage of the plug of Vickers is that is requires a complex manufacturing process to both form the plug and join the inner core to the outer shell. In addition, the plug of Vickers is incompatible with charge assemblies used with projectiles containing guidance elements or other impact sensitive elements.

Additional prior art cartridge case closure plugs are disclosed by U.S. Pat. Nos. 2,947,254, to Weiss, and 2,959,130, to Weiss et al. Both of the plugs disclosed by the patents of Weiss and Weiss et al are constructed of a plastic material, such as phenolic resin or other thermo-setting resins, reinforced with wood pulp, paper pulp, kraft pulp or chopped cloth. Again, the disadvantage of the devices disclosed by Weiss and Weiss et al is that construction of the plugs requires a complex and time consuming manufacturing process and such plugs are incompatible with charge assemblies used with projectiles containing guidance elements or other impact sensitive elements.

More recent developments in the art of cartridge case closure plugs are illustrated by the rigid polyurethane foam plug disclosed in U.S. Pat. No. 3,598,058, to Smith. The plug of Smith is a cylindrically shaped polyurethane plug having a density of between 12 and 14.5 pounds per cubic foot after molding. The cylindrical body of the Smith plug is provided with a skirt portion which is adapted for insertion into the mouth of the cartridge case for sealing the propellant bed from the external environment. The disadvantage of using the plug of Smith with projectiles that incorporate guidance systems which are highly sensitive to impact loads is that the high density of the plug results in high impact loads on the projectile which can frequently damage the guidance elements and fin assembly of the projectile.

Additional cartridge case closure plugs have been developed and constructed of high density materials such as 18 pound per cubic foot polyurethane provided with a KEVLAR fiber insert. The fiber insert was necessitated by the tendency of the plug to spall during the process of ramming the projectile and cartridge case into the gun barrel. The disadvantages of the KEVLAR insert plug are, again, the plug requires a complex manufacturing process and, in addition, the high density of the plug material again results in high instantaneous impact loads acting on the projectile which result in damaged guidance elements and damaged fin assemblies.

The present invention of a lightweight, cartridge case closure plug provides a device for effectively sealing the propellant bed of a cartridge case and substantially reduces the impact loads on a projectile which incorporates highly sensitive guidance elements and fin assemblies.

SUMMARY OF THE INVENTION

Accordingly, there is provided in the present invention a cartridge case closure plug which closes the case effectively over the temperature and humidity cycle experienced during the cartridge case assembly life span. The plug substantially reduces the momentum of the plug fragments and substantially increases plug breakup at relatively low pressure in the shortest time span after ignition of the propellant bed so as to reduce the impact loads acting on the projectile. Enhanced plug breakup allows the propellant gases to quickly redistribute and reduce plug motion thereby reducing impact loads on the projectile.

The closure plug is cylindrically shaped and constructed of a polymeric foam such as polyethylene foam having a density of 9 pounds per cubic foot. Polyethylene foam is resilient and allows the plug to be inserted as manufactured in the cartridge case. The outer surface of the plug may be covered with an elastomeric coating such as liquid vinyl to lower the permeability of the plug.

The cylindrically-shaped plug is provided with a forward end and a rearward end with a stress riser or dimple centered on the forward end to facilitate plug breakup upon ignition of the propellant bed. The rearward end of the plug is provided with a tapered, cylindrically-shaped cavity which is centered on the rearward end and projects into the plug body and serves to reduce the mass of the plug, enhance plug breakup, and provides a resiliency to the rearward end of the plug which allows the plug to be inserted, as manufactured, in the cartridge case. Once the plug is inserted in the cartridge case, the resiliency of the polyethylene foam, combined with the resiliency of the cavity in the rearward end, exert a force circumferentially outward on the cartridge case rim so as to hold the plug in the case.

The cavity in the rearward end of the plug also provides a large, lateral, pressure-bearing surface upon which the propellant gases act to temporarily hold the plug in the cartridge case until plug breakup occurs. Upon expansion of the propellant gases into the cavity, the plug material between the rearward end cavity and the forward end dimple functions as a membrane, balloons out and ruptures to provide for rapid reduction of the pressure gradient between the rearward end and forward end of the plug. The reduction in the pressure gradient reduces the pressure forces propelling the plug fragments toward the projectile, thus reducing the momentum of the fragments and subsequent impact loads on the projectile.

A radially extending passageway is provided in the plug so as to communicate between the tapered, cylindrical cavity and the outer surface of the plug. The passageway functions to release air entrapped between the plug and the propellant bed when the plug is inserted in the cartridge case. The vent is closed by the cylindrical cartridge case wall extending over the passageway opening in the outer surface after the plug is inserted in the case.

The outer surface of the plug is provided with a taper which extends away from the rearward face of the plug and provides a sloping surface for attachment of the plug to the cartridge case by a press fit at the tapered surface of the plug.

OBJECTS OF THE INVENTION

It is an object of the present invention to provide a cartridge case closure plug which effectively closes a cartridge case over the entire temperature and humidity cycle experienced during the cartridge case assembly life span.

Another object of the present invention is to provide a cartridge case closure plug which reduces the impact loads acting on a projectile incorporating sensitive guidance elements and fin assemblies.

Another object of the present invention is to provide a cartridge case closure plug which enhances plug breakup in a short time span after ignition of the propellant bed.

Another object of the present invention is to provide a cartridge case closure plug which reduces the pressure gradient from the rearward end to the forward end of the plug after ignition of the propellant bed, and A further object of the present invention is to provide a cartridge case closure plug which reduces both the mass of the plug and the pressure forces propelling the plug fragments, thus reducing the impact loads on the projectile.

A further object of the present invention is to provide a cartridge case closure plug which substantially reduces the total mass of the plug, fragments at a relatively low pressure, and substantially reduces the momentum of the plug or plug fragments which will impact the projectile.

A still further object of the present invention is to provide a cartridge case closure plug with limited permeability.

A still further object of the present invention is to provide a cartridge case closure plug which can release air entrapped between the plug and the propellant bed when the plug is inserted in the cartridge case.

A still further object of the present invention is to provide a cartridge case closure plug which is inexpensive, easily manufactured, and easily inserted in the cartridge case as manufactured.

Other objectives, advantages, and novel features of the present invention will become apparent from the following detailed description of the invention when considered in conjunction with the drawings.

BRIEF DESCRIPTION OF THE DRAWINGS

A more complete appreciation of the invention and many of the attendant advantages therein will be readily understood by reference to the following detailed description when considered with the accompanying drawings in which like reference numerals designate like parts throughout the figures and wherein.

DESCRIPTION OF THE PREFERRED EMBODIMENT

Figure 1:
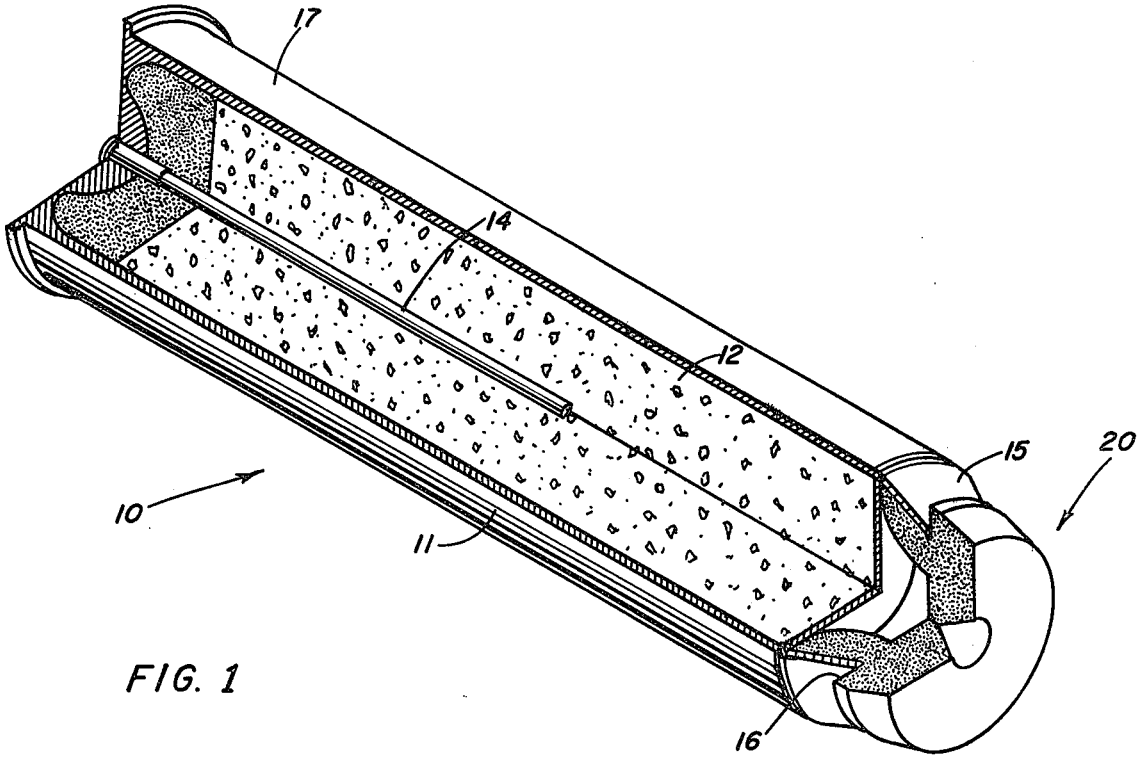
FIG. 1 illustrates an isometric view in partial section of the cartridge case closure plug of the present invention inserted in a cartridge case.

Referring to FIG. 1, there is illustrated in partial section an isometric view of the cartridge case closure plug 20 of the present invention. The plug is inserted in the opening 16 of cartridge case 10. Cartridge case 10 is constructed with body 11 having a forward end 15 and an after end 17. Forward end 15 with opening 16 is tapered to coincide in shape to the shape of plug 20. The cartridge case encompasses a propellant bed 12 of suitable explosive propellant which is ignited by igniter tube 14.

Figure 2:
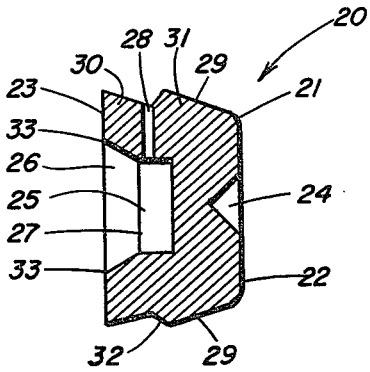
FIG. 2 illustrates a full section side view of the cartridge case closure plug of FIG. 1.
Figure 3:
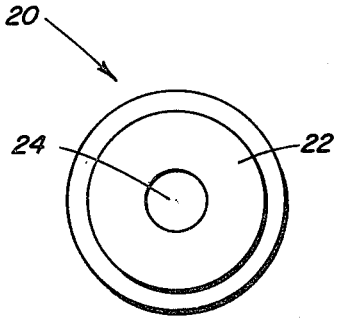
FIG. 3 illustrates an end view of the cartridge case closure plug illustrated in FIG. 1.

Referring additionally to FIGS. 2 and 3, there is illustrated the cartridge case closure plug of the subject invention. The plug is constructed with a cylindrically-shaped body 21 having the outer cylindrical surface 29. The body of the plug is constructed of a polymeric foam such as polyethylene foam having a density of 9 pounds per cubic foot, for example. The plug is easily manufactured to the proper configuration from stock foam material. The foam is a skinless polyethylene foam such as Ethafoam 900 and may be covered with an elastomeric coating, prior to insertion in the cartridge case, the lower the permeability of the plug. The elastomeric coating may be any low permeability material such as liquid vinyl or Flexabar. The polyethylene foam provides a plug which is strong enough to effectively close the cartridge case over the temperature/humidity cycle and also substantially reduces total plug mass and facilitates plug breakup at relatively low pressure. Constructing the plug of polyethylene foam yields a cartridge case closure plug which is resilient. The resiliency of the plug enables the plug to exert a circumferentially directed "spring force" against the cartridge case body 11 when positioned in opening 16 of forward end 15 of the case.

The plug body is provided with a forward face 22 and a rearward face 23 and the body is proportioned off into a skirt portion 30 and a crown portion 31. Crown portion 31 is formed by a taper which slopes positively from the forward face of the plug body to the rearward face. Skirt portion 30 of the plug is formed by a taper having a negative slope from the rearward face to the forward face. The taper of the skirt portion 30 forms shoulder 32 where it meets the taper of crown 31.

As illustrated in FIGS. 2 and 3, forward face 22 of plug body 21 is provided or furnished with a dimple or depression 24 which is centered on forward face 22. Dimple 24 is a cone-shaped depression which functions as a stress riser to enhance center blowout and plug breakup in a short time span and at relatively low pressure after ignition of the propellant bed. By enhancing plug breakup, the propellant gases quickly redistribute and reduce plug motion and thereby reduce impact loads on the projectile.

Rearward face 23 of plug body 21 is provided with a cylindrically-shaped cavity 33 having a cylindrical portion 25 and a tapered portion 26 with cylindrical portion 25 extending into the plug toward the forward face. Tapered portion 26 of cavity 33 opens onto the rearward face 23 of the plug and joins cylindrical portion 25 so as to form shoulder 27. The cylindrical cavity 33 reduces the mass of the plug so as to reduce the instantaneous impact loads on the projectile and thus, also, enhances center blowout of the plug. The depth of the cylindrical cavity is selected to afford as large an internal, lateral surface area as possible while maintaining the structural integrity of the plug over the temperature and humidity cycle experienced during the life span of the cartridge case assembly.

The internal, lateral surface of cavity 33 is circumferentially positioned and axially directed with respect to the plug axis so as to provide a pressure bearing surface upon which the propellant gases act to temporarily hold the plug in the cartridge case until plug breakup occurs, thus reducing the momentum of the plug fragments.

Upon receipt of the propellant gases in cavity 33, the plug material between cavity 33 and dimple 24 functions as a membrane receiving a pressure wave, balloons out and ruptures and thus provides for rapid reduction of the pressure gradient between the rearward end and forward end of the plug. The reduction in the pressure gradient reduces the pressure forces propelling the plug fragments toward the projectile, thus reducing the momentum of the fragments and subsequent impact loads on the projectile.

Cavity 33 also provides the rearward end of the plug with additional resiliency such that, when the plug is inserted and compressed in the cartridge case opening 16, the resiliency of the polyethylene foam, combined with the resiliency of the cavity in the rearward end, exert a force circumferentially outward on the case so as to hold the plug in the cartridge case.

As illustrated in FIG. 2, skirt 30 of the plug body 21 is provided with at least one radially extending passageway 28 which communicates between outer surface 29 and cylindrical portion 25 of cylindrical cavity 33. Passageway 28 serves to release air entrapped between the cartridge case closure plug and the propellant bed 12, illustrated in FIG. 1, when the plug is inserted into the cartridge case assembly. Passageway 28 will be closed by the case body when the body extends over the passageway after insertion of the plug in the case.

As illustrated in FIG. 1, the cartridge case closure plug of the subject invention is inserted in opening 16 of case 10. The plug may be inserted in the case by compressing it through a funnel (not shown) which is positioned on opening 16 of the case and by driving the plug through the funnel with a ram so as to insert the plug into the case.

It is thus apparent that the disclosed cartridge case closure plug, described herein, provides a means for effectively sealing a cartridge case over the temperature and humidity cycle experienced during the life span of the cartridge case assembly. The plug enhances plug breakup in the shortest time span after ignition of the propellant bed and substantially reduces the momentum of the plug fragments. The plug of the subject invention is inexpensive, easily manufactured, and can be inserted in the cartridge case as manufactured or first covered with a low permeability coating prior to insertion.

Many obvious modifications and embodiments of the specific invention, other than those set forth above, will readily come to mind to one skilled in the art having the benefit of the teachings presented in the foregoing description and the accompanying drawings of the subject invention and hence it is to be understood that such modifications are included within the scope of the appended claims.

What is claimed as new and desired to be secured by Letters Patent of the United States is:

1. A plug for closing the open end of a propellant-containing cartridge case which has an inturned rim at its open end comprising:

a plug body of low density resilient foam material having a forward end and a rearward end;

said plug body including a tapered peripheral portion adjacent its rearward end adapted to be inserted into the cartridge case open end for complementary seating resiliently against the inturned rim for temporarily restraining it therein under pressure of gases when the propellant is activated;

a depression in the forward end of the plug body;

a cavity in the rearward end of the plug body to reduce the mass thereof and to reduce the thickness of the plug between the depression and the cavity to define a membrane;

whereby propellant combustion gases reaching the cavity first rupture the membrane while still exerting a force circumferentially on the cartridge case rim for momentarily holding the plug tapered portion in place thereagainst to allow reduction of pressure gradient across the membrane to reduce pressure forces propelling plug complete breakup fragments forward.

2. The invention according to claim 1 wherein the depression in the forward end of the plug body is cone shaped.

3. The invention according to claim 1 wherein the cavity includes a cylindrical recess portion within the rearward end of the plug body to receive propellant combustion gases to radially expand the tapered portion into the rim.

4. The invention according to claim 3 wherein the cavity further includes a conical recess portion adjacent to rearward end of the plug.

5. The invention according to claim 1 further defined by the plug body being formed of polyethylene foam.

6. The invention according to claim 5 wherein the polyethylene foam has a density of around 9 pounds per cubic foot.

7. A plug for closing a cartridge case which case has an inturned peripheral rim around an open end thereof, comprising:

a plug body having a forward end and a rearward end having respective depression means and cavity means projecting into their surfaces for reducing the thickness of the plug therebetween to define a membrane area;

said plug formed of low density resilient foam material and having a peripheral taper portion adjacent its rearward end for resilient seating against the inturned rim for temporarily restraining the plug in the cartridge case open end;

whereby, upon initiation of an explosive bed in the cartridge case, expanding gases initially balloon out and rupture the membrane area of the plug while urging the plug peripheral taper portion against the rim for temporarily restraining it in position to allow time for reduction of pressure gradient across the membrane area to reduce pressure forces propelling complete plug breakup fragments forward.

* * * * *